US009464479B1

(12) United States Patent
Kee

(10) Patent No.: US 9,464,479 B1
(45) Date of Patent: Oct. 11, 2016

(54) BARRIER STOP APPARATUS

(71) Applicant: Overhead Door Corporation, Lewisville, TX (US)

(72) Inventor: Tick C. Kee, Dallas, TX (US)

(73) Assignee: Overhead Door Corporation, Lewisville, TX (US)

( * ) Notice: Subject to any disclaimer, the term of this patent is extended or adjusted under 35 U.S.C. 154(b) by 219 days.

(21) Appl. No.: 13/843,798

(22) Filed: Mar. 15, 2013

(51) Int. Cl.
*E05D 13/00* (2006.01)
*E06B 9/84* (2006.01)
*E05F 5/00* (2006.01)

(52) U.S. Cl.
CPC .. *E06B 9/84* (2013.01); *E05F 5/00* (2013.01)

(58) Field of Classification Search
CPC ..... E06B 9/80; E06B 9/82; E06B 9/84; E06B 9/88; E05D 13/003; A62B 1/08; A62B 1/10; F16D 43/14; F16D 43/16; F16D 59/00; F16D 2043/145
USPC ..... 160/300; 49/322; 188/69, 185, 189
See application file for complete search history.

(56) References Cited

U.S. PATENT DOCUMENTS 2,869,183 A 1/1959 Smith
3,966,027 A * 6/1976 Plitzkow ..... 188/182
4,112,996 A 9/1978 Fohl
4,125,142 A 11/1978 Fohl
4,410,072 A * 10/1983 Dickinson et al. ..... 192/223.1
4,604,828 A 8/1986 Baarse
4,704,914 A 11/1987 Horng
4,848,522 A 7/1989 Wolf
5,310,022 A * 5/1994 Sheridan et al. ..... 187/305
5,494,093 A 2/1996 Eiterman
6,070,641 A * 6/2000 Budetti ..... 160/302
6,206,078 B1 * 3/2001 Frey, Jr. ..... 160/302
7,428,918 B2 * 9/2008 Martin ..... 160/191
2012/0031701 A1 * 2/2012 Jones ..... 182/5
2014/0224596 A1 * 8/2014 Casebolt ..... 188/69

OTHER PUBLICATIONS

N F B Getriebe-Und Tortechnik GmbH Publication.

* cited by examiner

*Primary Examiner* — Katherine Mitchell
*Assistant Examiner* — Abe Massad
(74) *Attorney, Agent, or Firm* — Gardere Wynne Sewell LLP

(57) ABSTRACT

An apparatus for stopping the descent of a rolling type barrier includes a stator ring having a brake slot and a rotor rotatably disposed within the stator ring. The rotor includes at least one stop pawl pivotally attached to the rotor and configured to pivotably engage the brake slot when the rotor reaches a pre-determined rotational velocity. The apparatus further includes a latch pivotably attached to the stator ring. In response to the at least one stop pawl entering the brake slot, the latch secures the pawl in the brake slot.

21 Claims, 9 Drawing Sheets

BARRIER STOP APPARATUS

TECHNICAL FIELD

This invention relates to a rolling type barrier, and, more particularly, to a stop apparatus that is operative to stop the uncontrolled fall of a rolling barrier.

BACKGROUND OF THE DISCLOSURE

Various types of rolling doors have long been used to selectively open and close a doorway or other opening in a structure. A potential exists for damage to the door, the structure, as well as injury to users near the rolling door, in the event of an uncontrolled closing/dropping of the door. In an attempt to minimize and/or prevent such uncontrolled movement, door stop mechanisms have been created to stop and/or otherwise prevent this unintended downward movement of the door.

Many existing door stop mechanisms; however, fail to quickly stop the downward movement, lack or have unsatisfactory redundant/back-up stop mechanisms, and are difficult to accurately calibrate. For example, as a door drops, especially a door of increased weight, it gains momentum and thus speed thereby becoming increasingly more difficult to stop such motion. When the door stop mechanism attempts to stop the door, the door oftentimes will "bounce back" (i.e., upon initial contact, the door will abruptly contact the door stop apparatus and bounce or otherwise move in the upward/opposite direction, eventually settling back against the door stop), which can damage the door and/or the door stop mechanism.

Thus, it would be beneficial to have a mechanism suitable for all conditions of service that, among other things, is operable to quickly stop a door that is uncontrollably closing, includes a back-up/redundant stop mechanism, and allows for precise calibration.

SUMMARY

Other aspects, features, and advantages will become apparent from the following detailed description when taken in conjunction with the accompanying drawings, which are part of this disclosure and which illustrate, by way of example, principles of the inventions disclosed.

In a first aspect, there is provided an apparatus for stopping the descent of a barrier, such as, for example, a rolling door, a rolling grille, a counter shutter, a fire door, or any other type of door with a curtain that rolls up on a barrel. The apparatus includes a stator ring, a rotor rotatably disposed within the stator ring and a latch pivotally attached to the stator ring. The stator ring includes a brake slot on an inner surface of the stator ring. The rotor includes a stop pawl pivotally attached to the rotor and configured to pivot away from the rotor to engage the slot when the rotor reaches a pre-determined rotational speed. In response to the pawl engaging the brake slot, the latch secures the pawl in the brake slot to prevent bounce-back of the door.

In a second aspect, there is provided a method of calibrating an apparatus for stopping the descent of a barrier. The method includes rotating a drive shaft that is connected to a rotor having a stop pawl. The method also includes aligning the pawl with a calibration slot in a stator, the calibration slot is located approximately 210 degrees from the uppermost portion of the internal surface of the stator ring in a direction of rotation of the rotor when the door is lowered. The method also includes applying a predetermined weight to the pawl and adjusting a tension in a biasing mechanism attached to the pawl if the pawl does not rotate to a specific position during calibration.

In a third aspect there is provided a method of manufacturing a door stop system. The method includes forming a brake slot in a stator ring and positioning a rotor for rotational movement within the stator ring and pivotally attaching at least one stop pawl to the rotor. The stop pawl is configured to pivotably engage the brake slot when the rotor reaches a pre-determined rotational velocity. The method further includes pivotally securing a latch to the stator ring, the latch configured to, in response to the at least one stop pawl entering the brake slot, secure the stop pawl in the brake slot.

In a fourth aspect there is provided a door system having a barrier connected to a roll cylinder that is connected to a drive shaft and a rotor that is connected to the drive shaft. The rotor includes a stop pawl pivotally attached to the rotor. A stator encircles the rotor and is rotationally fixed with respect to the rotor. The stator includes a brake slot on an inner surface of the stator. The brake slot is only positioned in the stator approximately opposite from a location at which the rolling door unrolls from the roll cylinder so that the stop pawl contacts the brake slot when the drive shaft reaches a pre-determined angular velocity.

DESCRIPTION OF THE FIGURES

The accompanying drawings facilitate an understanding of the various embodiments.

DETAILED DESCRIPTION

Figure 1:
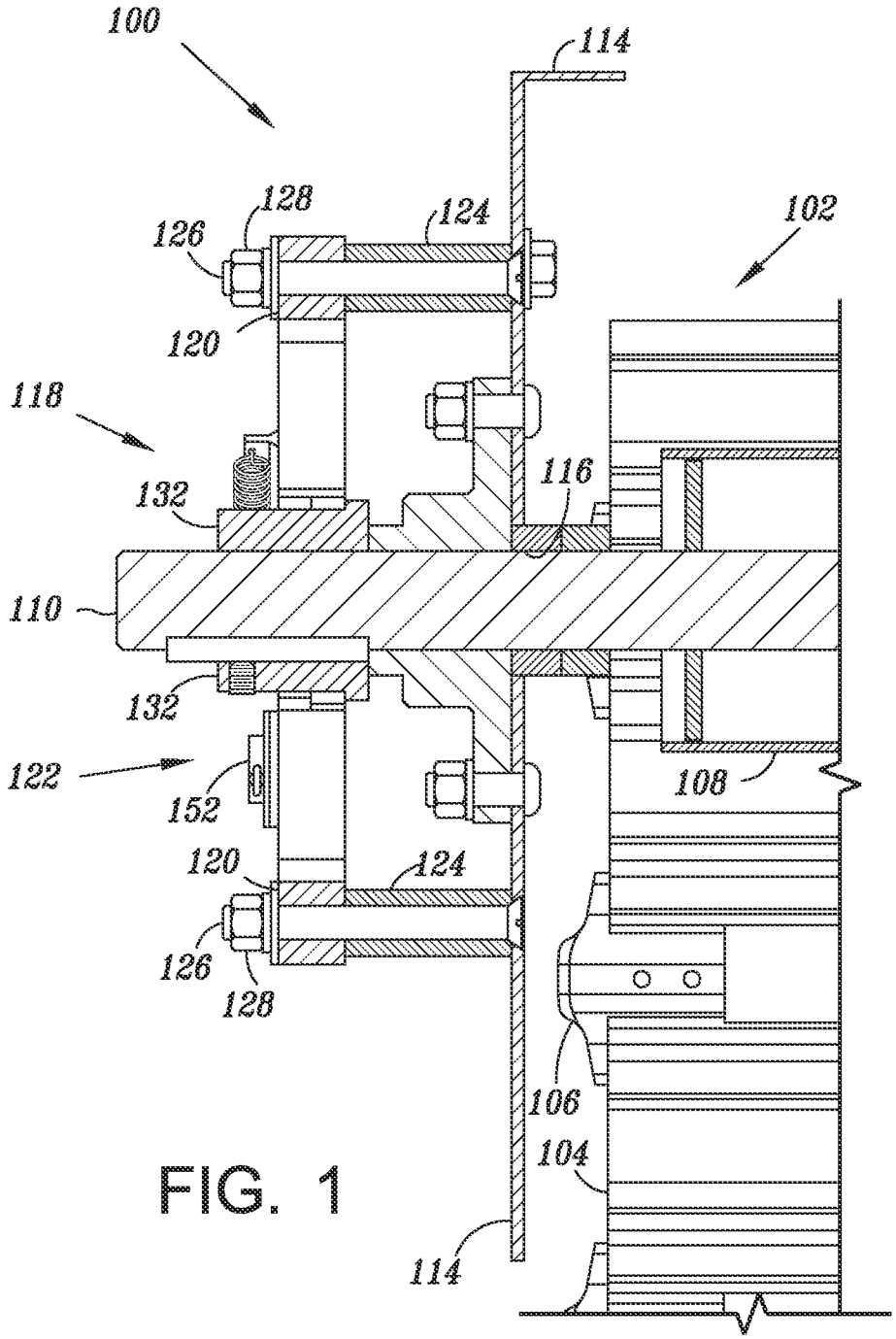
FIG. 1 is a sectional view of a rolling type barrier system.

Referring to FIG. 1, a rolling type door or barrier system 100 having an improved stop apparatus 118 is depicted for use with various types and sizes of vertically acting barriers 102. In particular and as explained in further detail below, the improved stop apparatus 118 is used in connection with rolling type barriers such as, for example, rolling doors, rolling grilles, counter shutters, fire doors, or any other type of door with a curtain that rolls up on a barrel. In the embodiment illustrated in FIG. 1, the stop apparatus 118 employs a latch 220 configured to stop a downward falling barrier 102 without any "bounce-back". For example, upon initial contact with the stop apparatus 118, the barrier 102 will be secured and will not, even in response to abrupt contact with the stop apparatus 118, bounce or otherwise move in the upward and opposite direction. Furthermore, the stop apparatus 118 includes a calibration slot 138 to facilitate more accurate calibration to prevent unintended actuation of the stop apparatus 118, and includes a plurality of stop pawls 162 and 164 to provide a back-up/redundant stopping mechanism. Furthermore, the stop apparatus 118 disclosed therein decreases the response time to stop the falling barrier 102, which minimizes the uncontrolled dropping distance of the barrier 102. As discussed in greater detail below, in response to uncontrolled downward movement of the barrier 102, a centrifugal force will cause the stop pawls 162 and 164 to rotate outwardly from a disengaged position for engagement with a brake slot 136. In response to either pawl 162 or 164 entering the brake slot 136, the latch 220 secures the pawl 162 or 164 within the brake slot 136 thereby eliminating any potential for bounce-back motion.

In the embodiment illustrated in FIG. 1, the rolling barrier system 100 includes a conventional, schematically-depicted rolling door 102, although any of the above-mentioned types of barriers could be used. The rolling door 102 consists of a plurality of relatively narrow slats 104 which extend horizontally the full length of a door opening (not shown). The slats 104 are joined at their lateral extremities to adjacent slats 104 at pivot joints 106 to permit articulation between all adjacent slats 104. As a result, the door 102 may be rolled onto and off of a barrel or roll cylinder 108 to effect opening and closing of the door 102. It will be appreciated that the slats 104, due to their articulation at pivot joints 106, are positioned in layers on roll cylinder 108 as the door is opened upwardly and played out vertically downwardly from the layered position as the door 102 is closed.

The roll cylinder 108 is attached to a drive shaft 110 for rotation therewith. The roll cylinder 108 may also house a torsion spring assembly (not shown) in a conventional fashion, which interacts with the drive shaft 110 in a known manner to provide a progressively increasing torsional force to the drive shaft 110 as the door 102 is lowered and a progressively decreasing force as the door 102 is raised, thereby counterbalancing the weight of the door 102 as it is closed and opened. In general, the drive shaft 110 may be actuated by a power system (not shown) to rotate roll cylinder 108 to open and close the door 102.

In FIG. 1, drive shaft 110 is supported axially outwardly of the ends of roll cylinder 108 by door end plate brackets 114. The door end plate brackets 114 may also support a cover (not shown), which forms a housing for the door 102 and the roll cylinder 108, except for a downward opening, which permits passage of the door 102 as it is raised and lowered. The door end plate brackets 114 and the cover are conventionally attached to a structure, such as a building, proximate the upper extremity of an opening in the structure. The door end plate brackets 114 have a generally central bore 116, which is adapted to receive the drive shaft 110 for free rotation relative to the door end plate brackets 116.

Figure 2:
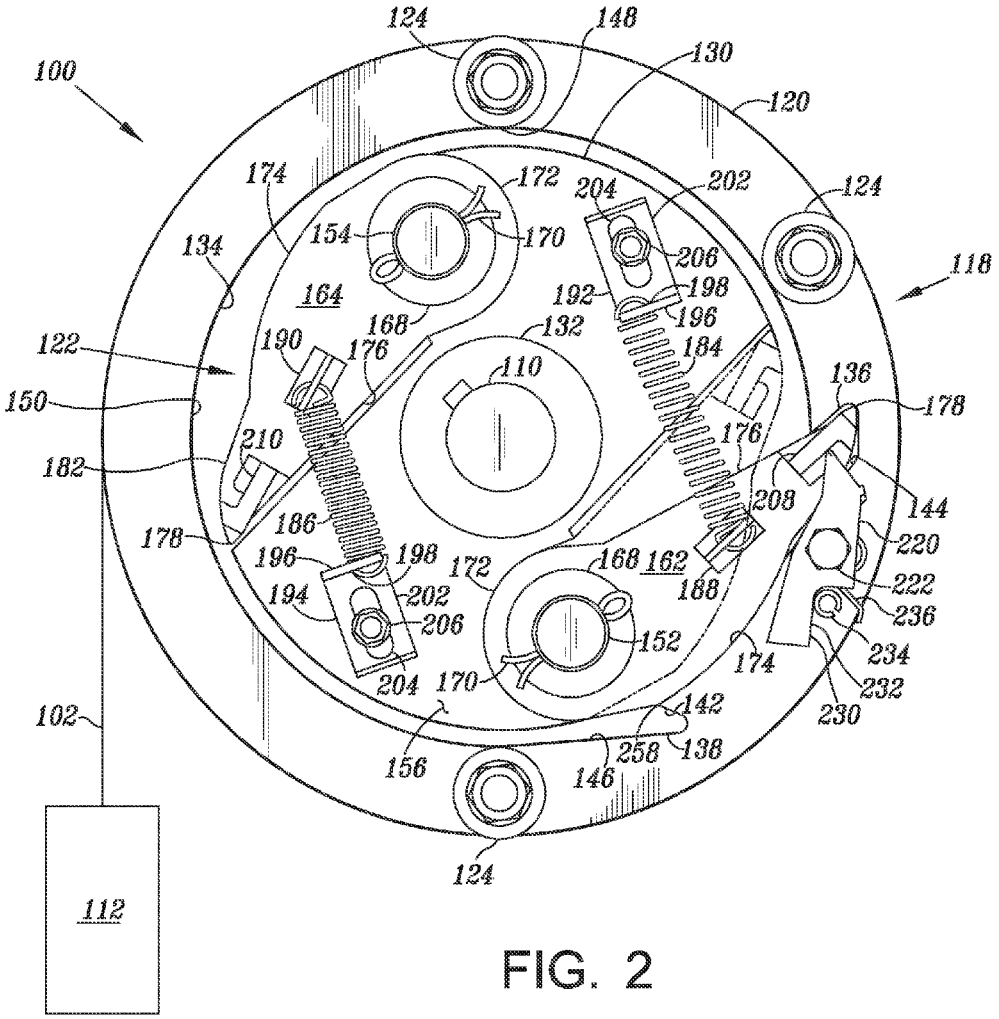
FIG. 2 is a side view of a portion of the barrier system of FIG. 1 taken along line 2-2 of FIG. 1 illustrating a stop apparatus.
Figure 5:
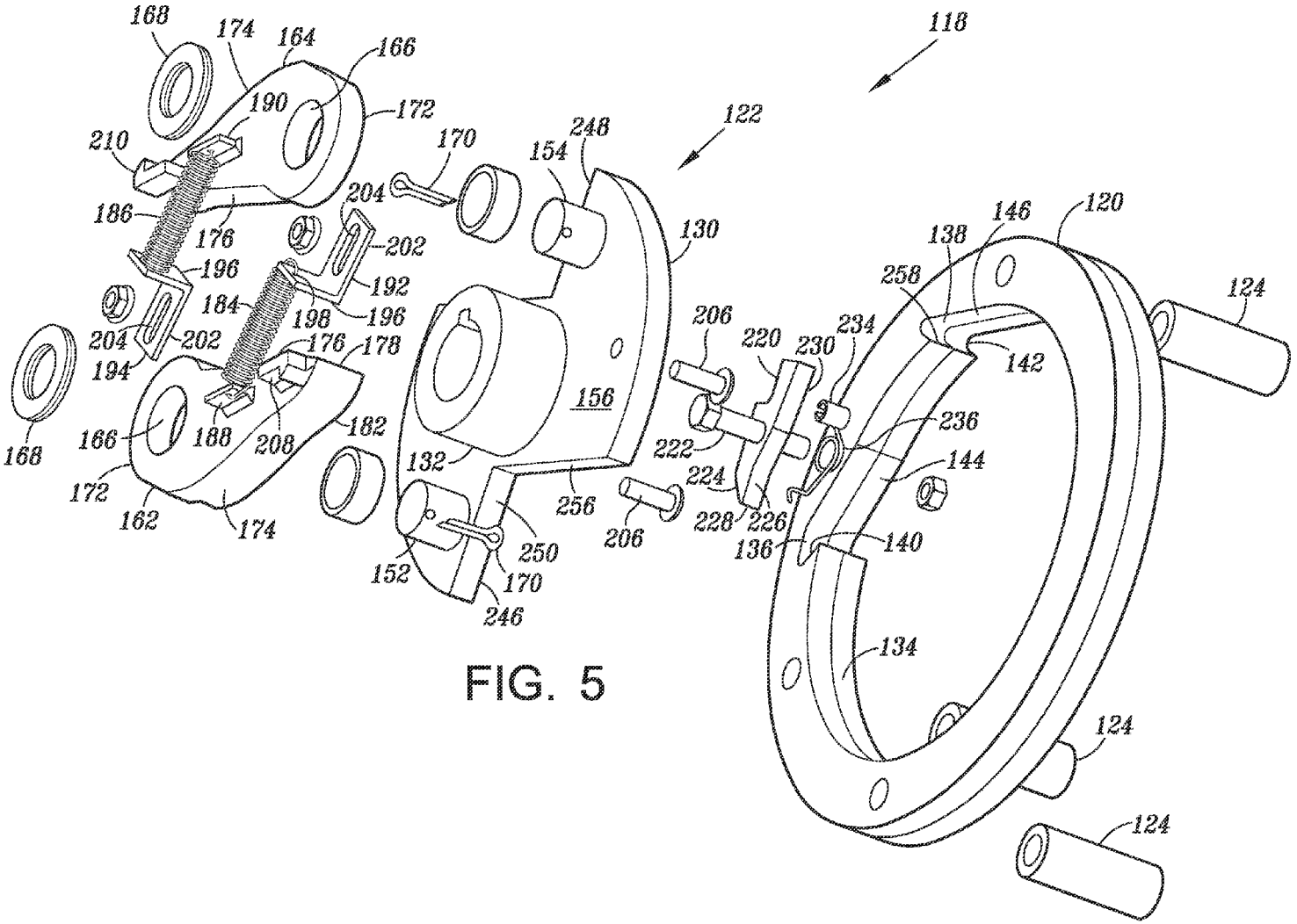
FIG. 5 is an exploded view of the stop apparatus illustrated in FIGS. 2 and 3.

In FIGS. 1, 2 and 5, the stop apparatus 118 is positioned preferably axially outwardly of one of the door end plate brackets 114. In general, the stop apparatus 118 includes a stator ring 120 as the primary fixed element thereof and a rotor assembly 122 as the primary rotating element thereof, both of which are centered about drive shaft 110. The stator ring 120 is positioned in selective spaced relation to door end plate bracket 114, as by one or more standoffs 124. The standoffs 124 and the stator ring 120 may be affixed to the door end plate bracket 114 by any suitable mechanism, such as, for example, bolts 126 and nuts 128. The stator ring 120 is thus mounted in a fixed position and spaced from the door end plate bracket 114 in coaxial relation to the drive shaft 110.

Referring specifically to FIG. 2, the rotor assembly 122 disposed and otherwise located within the stator ring 120. The rotor assembly 122 includes a rotor plate 130 that includes a hub 132. The hub 132 is secured to the drive shaft 110 and thus, the rotor plate 130 rotates with the drive shaft 110 during upward and downward movement of the door 102.

As illustrated in FIG. 2, the stator ring 120 has a generally cylindrical shape and includes an inner surface 134 provided with a generally U-shaped brake slot 136 and a generally U-shaped calibration slot 138. In particular, the brake slot 136 and the calibration slot 138 are recessed and otherwise formed in the inner surface 134 of the stator ring 120. The brake slot 136 and the calibration slot 138 are positioned at an angle to a direct radial orientation with respect to stator ring 120 to form a return lip 140 on the brake slot 136 and a return lip 142 on the calibration slot 138 for the purposes to be described hereinafter. Circumferentially displaced to the other side of the U-shaped brake slot 136 and the U-shaped calibration slot 138 from the return lips 140 and 142 are ramps 144 and 146 formed in the inner surface of stator ring 120. The ramps 144 and 146 smoothly merge into the U-shaped brake slot 136 and the U-shaped calibration slot 138. As illustrated, the ramps 144 and 146 are substantially linear and are oriented substantially tangentially to the inner surface 134 of the stator ring 120 and are configured, as discussed in greater detail below, to guide pawls 162 and 164, into slots 136 and 138. Both the brake slot 136 and the calibration slot 138 can be formed in other suitable orientations.

In the embodiment of FIG. 2, the drive shaft 110 and thus, the rotor assembly 122, are configured to rotate in a counterclockwise direction when the door 102 is lowered. The brake slot 136 is positioned at approximately 90 degrees in a clockwise direction from an uppermost portion 148 of the inner surface 134 of the stator ring 120 and the calibration slot 138 is positioned at approximately 150 degrees in a clockwise direction from an uppermost portion 148 of the inner surface 134 of the stator ring 120. Thus, in some embodiments, the brake slot 136 is located approximately opposite from an area 150 of the stator ring 120 adjacent to where the door 102 unrolls from the roll cylinder 108 when the door 102 is being lowered. In some embodiments, the drive shaft 110 and rotor plate 130 rotate in a clockwise direction when the door 102 is lowered and the brake slot 136 is located at approximately 270 degrees in a clockwise direction from an uppermost portion 148 of the inner surface 134 of the stator ring 120 and the calibration slot 138 is located at approximately 210 degrees in a clockwise direction from an uppermost portion 148 of the inner surface 134 of the stator ring 120.

The rotor assembly 122 includes a generally circular rotor plate 130 which is rotationally fixed to the drive shaft 110 by the hub 132 so that it rotates with the drive shaft 110. The hub 132 is affixed to the drive shaft 110 for rotation therewith by any suitable mechanism, such as, for example, a key positioned in key ways in the hub 132 and the drive shaft 110, respectively. The rotor assembly 122 is positioned within the stator ring 120 for selective operative interrelation between rotor assembly 122 and stator ring 120, as described in greater detail below.

Referring to FIG. 2, the rotor assembly 122 includes a first stub shaft 152 and a second stub shaft 154 extending from a face 156 of the rotor plate 130. The stub shafts 152 and 154 are positioned in bores 158 and 160 (FIG. 4) formed in rotor plate 130 and affixed therein by welds or any other suitable fixing mechanism. As shown in FIG. 2, the first stub shaft 152 is positioned on an opposite side of the rotor plate 130 from the second stub shaft 154.

The rotor assembly 122 also includes the first and second pawls 162 and 164 pivotably secured to the first and second stub shafts 152 and 154, respectively. The pawls 162 and 164 are a generally teardrop-shape each including a central through bore 166 (FIG. 3) sized to accommodate and rotate relative to respective stub shafts 152 and 154. As shown in FIGS. 2 and 5, the pawls 162 and 164 are axially restrained on the stub shafts 152 and 154 by a washer 168 and a cotter pin 170 positioned adjacent the pawls 162 and 164. Thus, the pawls 162 and 164 are freely pivotally mounted to the rotor plate 130 but axially restrained on the stub shafts 152 and 154, respectively.

Figure 2A:
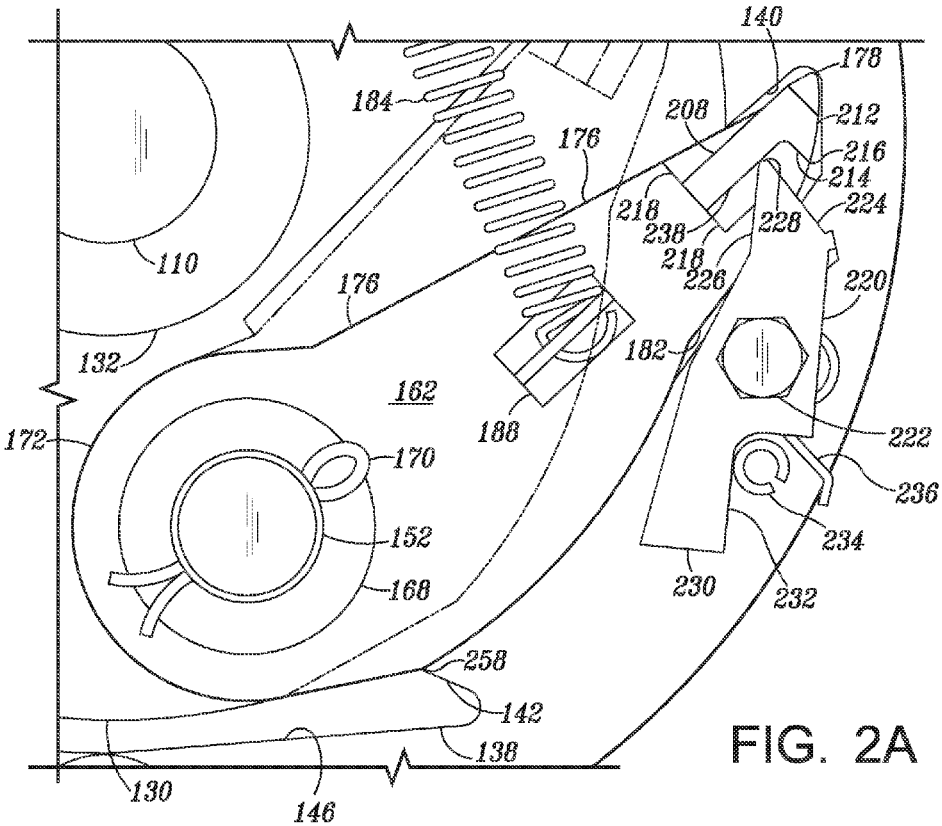
FIG. 2A is a detail view of a portion of the stop apparatus of FIG. 2.

The first pawl 162 and the second pawl 164 each include a circular end portion 172 having the central through bore 166. As illustrated in FIGS. 2 and 2A, curved surface 174 and a substantially linear surface 176 extend from the circular end portion 172 and converge to a tip 178. The pawls 162 and 164 are oriented in opposite directions such that the tip 178 of the first pawl 162 is mounted and otherwise extends opposite to the tip 178 of the second pawl 164. As shown, the curved surface 174 is substantially circular and preferably has a radius substantially equal to the radius of the rotor plate 130. As such, the curved surface 174 contacts the inner surface 134 of the stator ring 120 when the pawl 162 or 164 is in the engaged position and transfers forces experienced when the pawl 162 or 164 engages the brake slot 136 from the pawl 162 or 164 to the stator ring 120. A portion of the curved surface 174 in the area of tip 178 has a curved contact surface 182 of a substantially lesser radius than the curved surface 174. In operation, the curved contact surface 182 is adapted to engage the ramp 144 of the stator ring 120 adjacent to the brake slot 136 when the pawl 162 or 164 moves to the engaged position, as shown by the first pawl 162 in FIG. 2, in which the tip 178 of the first pawl 162 extends into the brake slot 136.

During rotational movement of the rotor plate 130, the pawls 162 and 164 pivotally move about the stub shafts 152 and 154 from the disengaged position, as shown by the second pawl 164 in FIG. 2, to the engaged position, as illustrated by the solid lines depicting the first pawl 162. A first biasing mechanism 184 biases the first pawl 162 inward and toward the rotor plate 130 and a second biasing mechanism 186 biases the second pawl 164 inward and toward the rotor plate 130. Thus, the biasing mechanisms 184 and 186 apply a constant biasing force to the first pawl 162 and second pawl 164 toward the disengaged position. The biasing mechanisms 184 and 186 may be, for example, a tension spring.

Referring specifically to FIG. 2, the biasing mechanisms 184 and 186 are connected to a first hook eye block 188 and a second hook eye block 190 attached to the first and second pawls 162 and 164, respectively. An opposite end of the biasing mechanisms 184 and 186 is connected to a first and second movable angle clips 192 and 194 that are adjustably attached to the rotor plate 130. The angle clips 192 and 194 each include an upstanding leg 196 with an aperture 198 to receive the biasing mechanisms 184 and 186 and a second leg 202 adjacent to the rotor plate 130. The second leg 202 includes a slot 204 for receiving a machine screw 206. By loosening the machine screw 206, the angle clips 192 and 194 are movably mounted on the rotor plate 130 to adjust the tension in the biasing mechanisms 184 and 186 and thereby increase or decrease the biasing force applied to the first and second pawls 162 and 164. The system 100 can be easily calibrated by adjusting the tension in the biasing mechanisms 184 and 186, as will be described in more detail below.

As described above, by loosening the machine screw 206, the angle clips 192 and 194 are adjustable to different positions on the rotor plate 130 in a direction generally axially of the biasing mechanism 184 and 186. In this fashion, the tension applied to the pawls 162 and 164 by the biasing mechanisms 184 and 186 can be varied to accommodate particular operating parameters.

Figure 3:
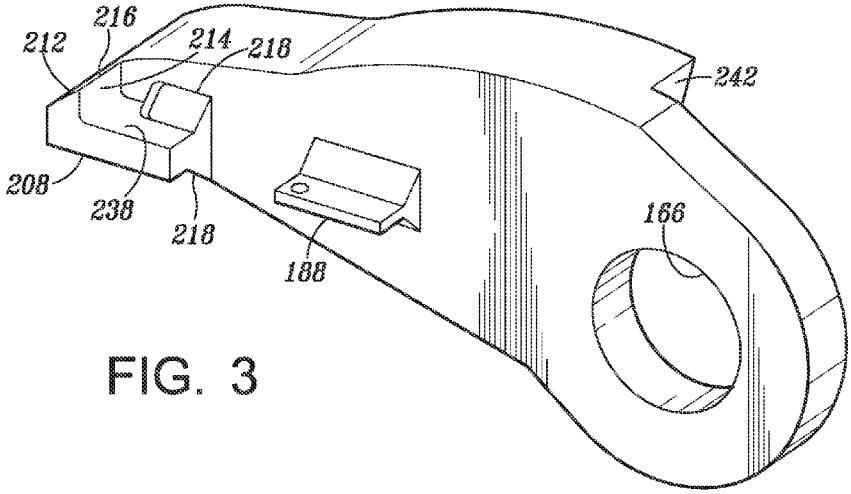
FIG. 3 is a perspective view of a stop pawl of the stop apparatus of FIG. 2.

The first and second pawls 162 and 164 also include a first protrusion 208 and a second protrusion 210, respectively, located proximate the tip 178 of the first and second pawls 162 and 164. Referring specifically to FIG. 3, the first pawl 162 is shown in greater detail and includes similar features to those of the second pawl 164 (not shown). The first protrusion 208 includes an angled surface 212 and a locking surface 214 that intersect at a protrusion point 216. Fillets 218 are optionally situated adjacent to the first protrusion 208 provide structural support to the first protrusion 208. The first protrusion 208 may be attached to the first pawl 162 by any suitable attachment, such as, for example, a welded attachment, or alternatively, the first protrusion 208 is formed integral to the first pawl 162.

Referring to FIGS. 2 and 5, the first and second protrusions 208 and 210 are configured to engage the latch 220 located on the stator ring 120 adjacent to the brake slot 136. As shown in FIG. 2, the latch 220 is pivotally secured on a shaft 222 externally from the stator ring 120. The latch 220 includes a latch locking and an engagement surface 226 that intersect at a tip 228 of the latch 220 as illustrated in FIG. 2A. An opposite, lateral end 230 of the latch 220 includes a stopper surface 232 that engages a stopper 234.

In FIG. 2A, the latch 220 is biased by a biasing mechanism 236 such that the tip 228 of the latch 220 is biased to rotate toward the rotor plate 130. However, the rotation of the tip 228 of the latch 220 towards the rotor plate 130 is limited by the stopper 234, which contacts the stopper surface 232 of the latch 220. As such, the tip 228 remain spaced apart and does not contact the rotor plate 130 or the first and second pawls 162 and 164 while the pawls 162 and 164 are in the disengaged position.

Referring to FIGS. 2 and 2A, the latch 220 is configured to contact the first protrusion 208 or 210 of the pawl 162 or 164 that engages the brake slot 136. For example, as the curved surface 174 of the first pawl 162 contacts and slides along the ramp 144 of the brake slot 136, the angled surface 212 of the first protrusion 208 contacts the engagement surface 226 of the latch 220. As the tip 178 of the first pawl 162 moves further into the brake slot 136, the protrusion point 216 passes the tip 228 of the latch 220 and the tip 228 of the latch 220 rotates toward the rotor plate 130 until the tip 228 engages the second locking surface 238 of the first protrusion 208. The tip 228 of the latch 220 is then locked against the locking surface 214 and the second locking surface 238 of the first protrusion 208. The interaction between the latch 220 and the first protrusion 208 prevents the first pawl 162 from bouncing out of the brake slot 136 after entering the brake slot 136, which oftentimes occurs when a door 102 drops with excessive velocity. The first pawl 162 is retained in the brake slot 136 until the drive shaft 110 is rotated slightly in a clockwise direction and a user applies a force to the lateral end 230 of the latch 220 to release the latch 220 from the first protrusion 208.

Figure 4:
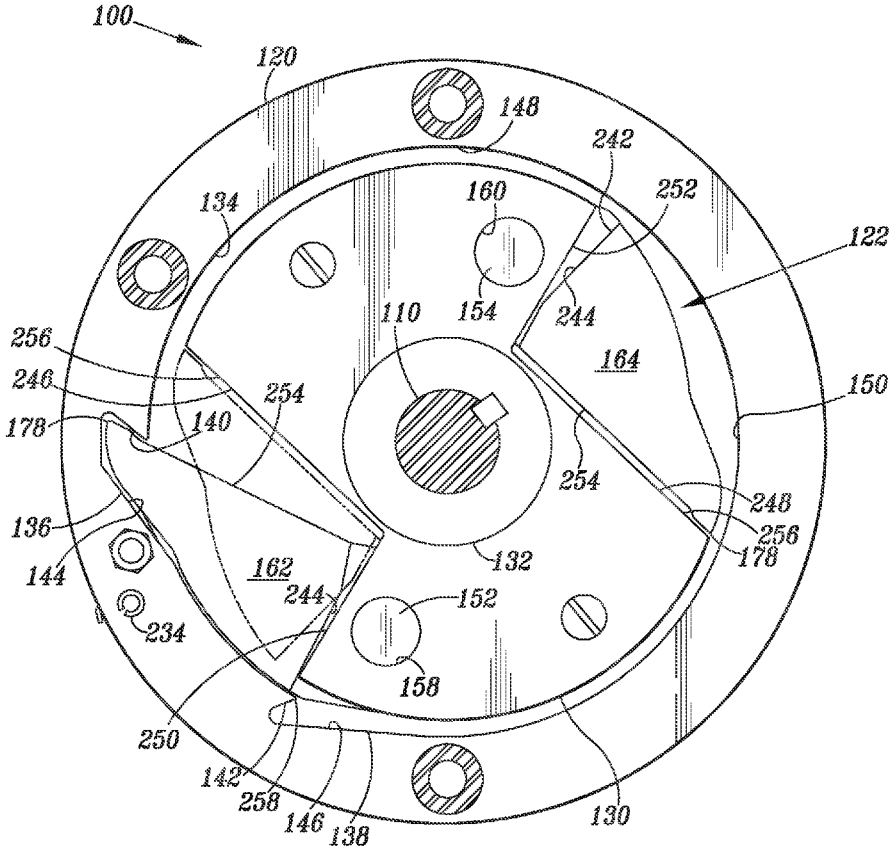
FIG. 4 is a sectional view of the stop apparatus of FIG. 1 taken along line 3-3 of FIG. 1.

Referring to FIGS. 3 and 4, a bottom surface 240 of the first pawl 162 includes a ledge 242 having a contact surface 244 for purposes discussed below. The second pawl also includes a similar ledge 242 having a contact surface 244. As seen in FIG. 4, the rotor plate 130 includes a cutout 246 forming a first stop surface 250 and a second cutout 248 forming a second stop surface 252. When the first and second pawls 162 and 164 are in the disengaged position, a portion of resting surface 254 is adjacent to and/or otherwise contacts the back wall 256 of the first and second cutouts 246 and 248, respectively. When the first pawl 162 or second pawl 164 is positioned in the engaged position (due to rotational movement of the rotor 130), as shown by the first pawl 162 in FIG. 4, the contact surface 244 of the first or second pawls 162 or 164 contact the stops 250 or 252 of the first or second cutouts 246 and 248, respectively. With this arrangement, the forces applied to the first and second pawls 162 or 164 resulting from the tip 178 engaging the brake slot 136 and the curved surface 174 engaging the inner surface 134 of the stator ring 120 are transmitted directly through pawl 162 or 164 to the rotor plate 130. In particular, as a result of the contact surface 244 engaging and/or otherwise contacting the limit stops 250 or 252 of the cutouts 246 or 248 and curved surface 174 engaging the inner surface 134 of the stator ring 120, the abrupt stopping forces applied to the pawls 162 or 164 by the stationary stator ring 120 are transmitted directly therethrough to the rotor plate 130 without imparting shearing forces to the stub shafts 152 and 154, which could result in damage or misalignment of the components of rotor assembly 122 and/or failure of the stop apparatus 118.

During operation, the drive shaft 110 is actuated in conventional fashion to raise and lower the door 102 with the pawls 162 and 164 maintained in the disengaged position via the biasing mechanisms 184 and 186. In the event of a door failure, which results in a faster and/or uncontrolled descent of the door 102, the rotation of drive shaft 110 at a rotations per minute (RPM) in excess of its normal operating RPM imparts an increased centrifugal force to the first and second pawls 162 and 164. Once the centrifugal force reach a value in excess of the preset tension provided by the biasing mechanisms 184 and 186, the first and second pawls 162 and 164 swing outwardly (i.e., away from the rotor plate 130). The curved contact surface 182 of the first pawl 162 or 164 that is positioned to initially engage the brake slot 136 slideably engages with the ramp 144 of the brake slot 136 to direct the tip 178 of pawl 162 or 164 into the brake slot 136.

With continued movement of the first or second pawl 162 or 164 into the brake slot 136, the latch 220 engages the protrusion 208 or 210 of the pawl 162 or 164 that is first to enter the brake slot 136. The angled surface 212 of the protrusion 208 of the pawl 162 or 164 contacts and applies a force to the engagement surface 226 of the latch 220, moving the tip 228 of the latch 220 away from the rotor plate 130. The tip 228 of the latch 220 moves along the angled surface 212 until the tip 228 passes the protrusion point 216, at which time the latch 220 pivots under a biasing force so that the tip 228 contacts the second locking surface 238 of the protrusion 208 or 210. The contact between the tip 228 of the latch 220 and the protrusion 208 or 210 locks the pawl 162 or 164 in the engaged position until a user manually releases the latch 220. Thus, the pawl 162 or 164 is locked in the engaged position the first time that the pawl 162 or 164 enters the brake slot 136 and the pawl 162 or 164 is thereby prevented from bouncing out of the brake slot 136.

When resetting the stop apparatus 118, the user presses the lateral end 230 of the latch 220 to rotate the latch 220 away from the pawl 162 or 164. Once the latch 220 is disengaged, the drive shaft 110 is rotated until the tip 178 of pawl 162 and 164 clears the return lip 140 of the brake slot 136. At that time, the biasing mechanism 184 and 186 automatically retracts the pawl 162 or 164 to the disengaged position to enable upward and downward movement of the rolling door system 100.

It is to be noted that with the 180-degree circumferential positioning of the first pawl 162 and the second pawl 164 with respect to the drive shaft 110, the drive shaft 110 will be locked due to engagement of a pawl 162 and 164 with the brake slot 136 shortly after the designated RPM is reached and usually within one half turn of the drive shaft 110, or, in other words, within a 180 degree turn of the drive shaft 110.

Figure 6:
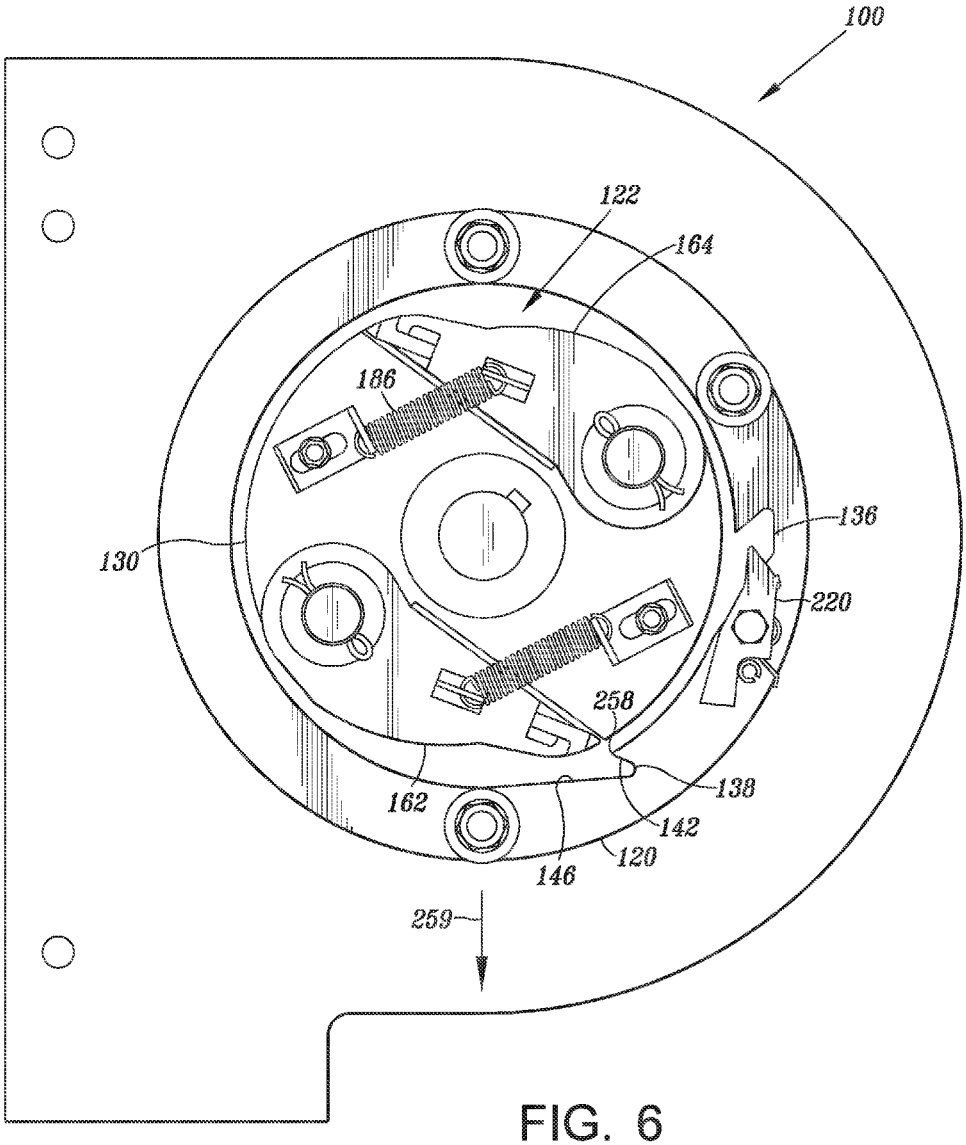
FIG. 6 is a side view of the stop apparatus with first and second pawls in a disengaged position.

The system 100 is also easily calibrated to set the drive shaft RPM at which the pawls 162 and 164 will pivot to contact the stator ring 120 and engaged the brake slot 136. Referring to FIG. 6, the calibration process is described in connection with the first pawl 162 and the first biasing mechanism 184. The same process can be performed to calibrate the second pawl 162 and the second biasing mechanism 186.

The calibration process begins by aligning the first pawl 162 so that the tip 178 of the first pawl 162 is above and slightly behind the point 258 of the return lip 142 of the calibration slot 138. A user presses downward on the first pawl 162 until the first pawl 162 touches the ramp 146 of the calibration slot 138. Upon releasing the first pawl 162, the first pawl 162 should return to its position against the rotor plate 130, as shown in FIG. 6. If the first pawl 162 does not return to its position against the rotor plate 130, the tension in the first biasing mechanism 184 should be increased, by adjustments as described herein.

Figure 7:
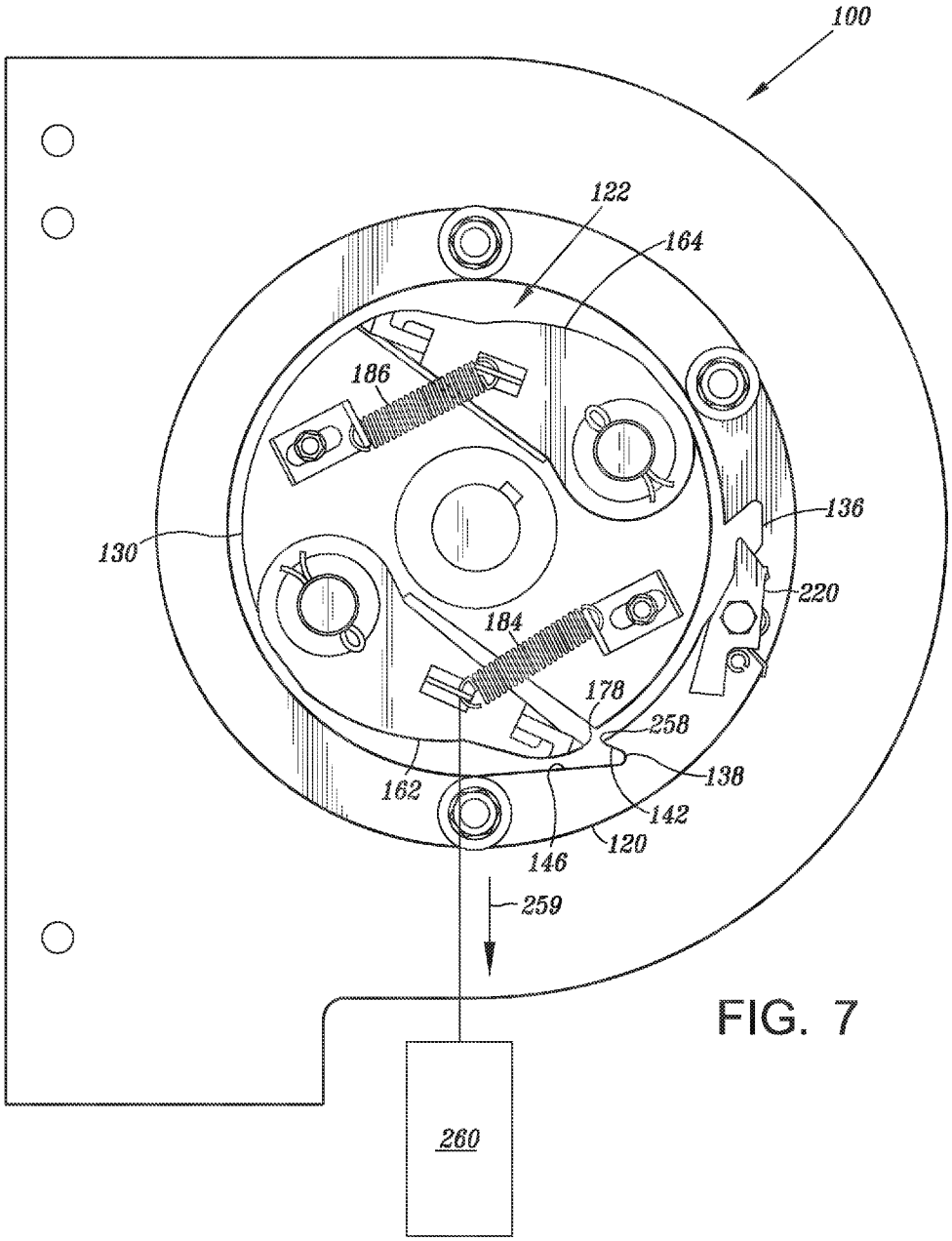
FIG. 7 is a side view of the stop apparatus of FIG. 6 having a weight applied to the first pawl.

Referring now to FIG. 7, to determine whether the tension in the first biasing mechanism 184 is too high, a predetermined weight 260 (for example, 10 ounces) is attached to the first pawl 162 at the first hook eye block 188. The first pawl 162 thus pivots toward the engaged position, as shown in FIG. 7. If properly calibrated, the tip 178 of the first pawl 162 aligns with the point 258 of the return lip 142 of the calibration slot 138, as shown in greater detail in FIG. 8. If the tip 178 of the first pawl 162 is above the point 258 of the return lip 142 of the calibration slot 138, the tension in the first biasing mechanism 184 should be reduced. If the tip 178 of the first pawl 162 is below the point 258 of the return lip 142 of the calibration slot 138, or if the first pawl 162 contacts the ramp 146 of the calibration slot 138, the tension in the first biasing mechanism 184 should be increased.

Figure 8:
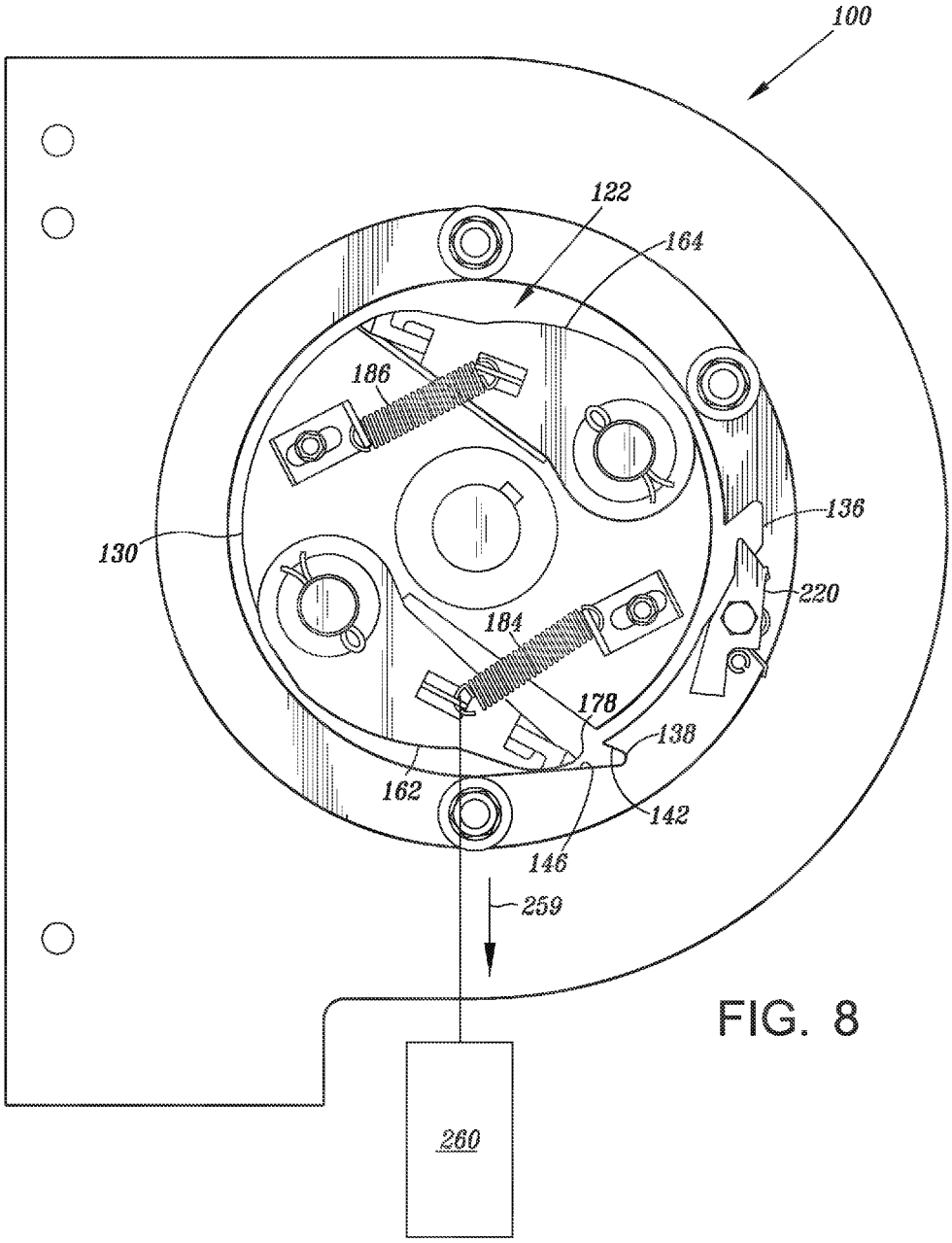
FIG. 8 is a side view of the stop apparatus of FIGS. 6 and 7 in which the first pawl is in contact with a stator.

Referring to FIG. 8, an additional calibration test is conducted by pressing the first pawl 162 against the ramp 146 of the calibration slot 138 while the weight 260 is attached to the first pawl 162. When the force is released, the first pawl 162 should remain against the ramp 146 if the first biasing mechanism 184 is properly calibrated. If the first pawl 162 does not remain against the ramp 146, the tension in the first biasing mechanism 184 should be reduced.

Figure 9:
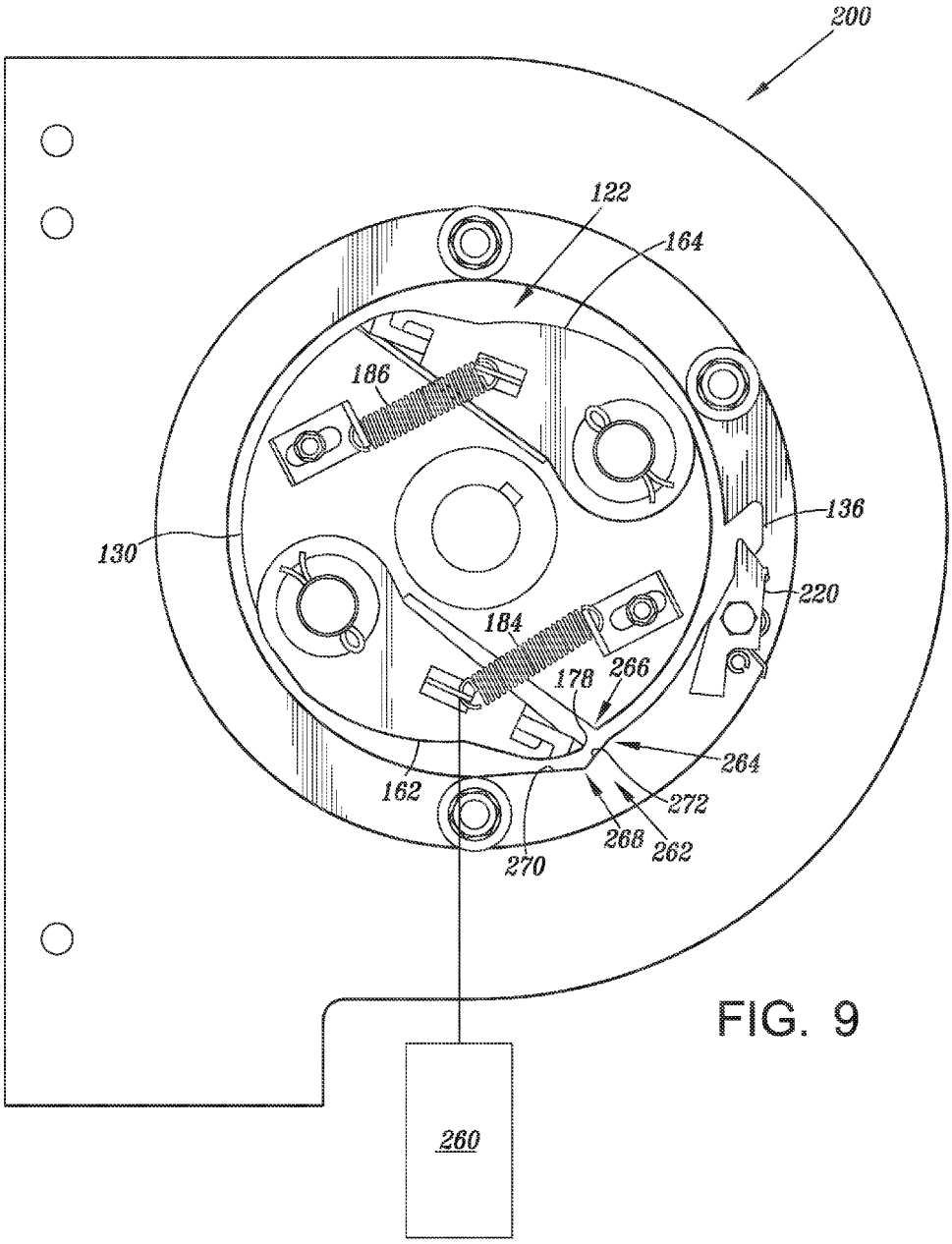
FIG. 9 is a side view of an alternate embodiment of a stop apparatus having a weight applied to the first pawl.

Referring now to FIG. 9, an alternate embodiment of a rolling door system 200 with a modified calibration slot 262 is shown using like numeral for parts that are similar to those described above. As described above, the calibration slot 262 can be any suitable shape that allows for calibration of the system 200. In the embodiment shown in FIG. 9, the calibration slot 262 includes a bottom wall 270 and a side wall 272 that intersect at a point 268. At an opposite end of the side wall 272 from the point 268, the calibration slot 262 includes a calibration point 264.

The calibration process is described in connection with the first pawl 162 and the first biasing mechanism 184, however, the same process can be performed to calibrate the second pawl 162 and the second biasing mechanism 186. The calibration process begins by aligning the first pawl 162 so that the tip 178 of the first pawl 162 is above and slightly behind the point 268 (i.e., positioned slightly clockwise from the point 268) at the intersection of the bottom wall 270 and the side wall 272 of the calibration slot 262. In this position, the first pawl 162 rests against the rotor plate 130, similar to the position of the first pawl 162 in FIG. 6. A user next presses downward on the first pawl 162 until the first pawl 162 touches the bottom wall 270 of the calibration slot 262. Upon releasing the first pawl 162, the first pawl 162 should return to its position against the rotor plate 130. If the first pawl 162 does not return to its position against the rotor plate 130, the tension in the first biasing mechanism 184 should be increased, by adjustments as described herein.

Referring specifically to the orientation shown in FIG. 9, to determine whether the tension in the first biasing mechanism 184 is too high, a predetermined weight 260 (for example, 10 ounces) is attached to the first pawl 162 at the first hook eye block 188. The first pawl 162 thus pivots toward the stator ring 120, as shown in FIG. 9. If properly calibrated, the tip 178 of the first pawl 162 is situated about half way between the point 266 of the rotor plate 130 and the point 268 of the stator ring 120. If the tip 178 of the first pawl 162 is situated closer to the point 266 of the rotor plate 130, the tension in the first biasing mechanism 184 should be reduced. If the tip 178 of the first pawl 162 is situated closer to the point 268 of the stator ring 120, or if the first pawl 162 contacts the bottom wall 270 of the calibration slot 262, the tension in the first biasing mechanism 184 should be increased.

An additional calibration test is conducted by pressing the first pawl 162 against the bottom wall 270 of the calibration slot 262 while the weight 260 is attached to the first pawl 162. When the force is released, the first pawl 162 should remain against the bottom wall 270 if the first biasing mechanism 184 is properly calibrated. If the first pawl 162 does not remain against the bottom wall 270, the tension in the first biasing mechanism 184 should be reduced.

Accordingly, embodiments disclosed herein provide a stop apparatus 118 that, among other things, eliminates the likelihood of bounce-back of the door 102 in response to an uncontrolled drop of the door 102, is easily calibrated to accommodate barriers 102 of differing weights and includes first and second pawls 162 and 164, which provides a redundant or back-up arrangement in the event one of the pawls 162 or 164 fail. Furthermore, embodiments disclosed herein provide a stop apparatus 118 that is a positive mechanical stop device rather than a friction stop device.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments and it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An apparatus configured for stopping the descent of a rolling type barrier, comprising:

a stator ring having a brake slot;

a rotor rotatably and coaxially disposed within the stator ring, wherein the rotor includes at least one stop pawl pivotally attached to the rotor and biased toward the rotor to engage the brake slot when the rotor exceeds a pre-determined rotational velocity such that the at least one stop pawl rotates outward away from the rotor, wherein the at least one stop pawl has a front face defining a first plane perpendicular to the rotor's axis of rotation; and a latch pivotably attached to the stator ring, wherein the latch has a front surface facing the front face of the stop pawl, the front surface defining a second plane parallel to said first plane of the front face of the at least one stop pawl, wherein, in response to the at least one stop pawl entering the brake slot, the latch contacts the at least one stop pawl and secures the pawl in the brake slot; wherein the latch engages an axial protrusion on the stop pawl, the axial protrusion extending from the front face of the stop pawl in a direction non-parallel relative to the first plane.

2. The apparatus of claim 1, wherein the stop pawl comprises first and second stop pawls.

3. The apparatus of claim 2, wherein the first stop pawl is pivotally attached to the rotor on an opposite side of the rotor from the second stop pawl.

4. The apparatus of claim 1, wherein the latch includes a tip that contacts the axial protrusion of the stop pawl, the axial protrusion extending from the front face of the stop pawl to reach the second plane of the latch, wherein the tip is biased toward the rotor to secure the pawl in the brake slot.

5. The apparatus of claim 1, wherein the stator ring further comprises a calibration slot not to be engaged with the at least one stop pawl when the rotor reaches a speed for the stop pawl to engage the brake slot, the calibration slot providing a reference to the stop pawl when a static calibration weight is applied to the stop pawl to simulate a centrifugal force to be generated at said speed.

6. The apparatus of claim 4, wherein the stator ring comprises only one brake slot.

7. The apparatus of claim 5, wherein the calibration slot is located between about 200 degrees and 220 degrees from the uppermost portion of an internal surface of the stator ring in a direction of rotation of the rotor when the barrier is lowered.

8. The apparatus of claim 1, further comprising a biasing mechanism disposed on the rotor for biasing the stop pawl toward the rotor.

9. The apparatus of claim 1, wherein the brake slot is located approximately 270 degrees from the uppermost portion of an internal surface of the stator ring in a direction of rotation of the rotor when the barrier is lowered.

10. The apparatus of claim 1, wherein the rotor comprises a cutout and the stop pawl engages the cutout when the stop pawl contacts the brake slot.

11. The apparatus of claim 1, wherein the rotor comprises a first stop pawl and a second stop pawl positioned on an opposite side of the rotor from the first stop pawl, wherein the rotor comprises a first cutout adjacent the first stop pawl and a second cutout adjacent the second stop pawl.

12. The apparatus of claim 1, wherein the at least one stop pawl is pivotally movable in response to centrifugal force.

13. A method of calibrating the apparatus of claim 1, the method comprising:

rotating the drive shaft, wherein the drive shaft is connected to the rotor that comprises the stop pawl, the rotor rotatable with the drive shaft;

aligning the pawl with a calibration slot in the stator, wherein the calibration slot is located approximately 210 degrees from the uppermost portion of the internal surface of the stator ring in a direction of rotation of the rotor when the barrier is lowered;

applying a predetermined weight to the pawl; and adjusting a tension in a biasing mechanism attached to the pawl to move the pawl to a predetermined position.

14. A method of the apparatus of claim 1, comprising:

forming the brake slot in the stator ring;

positioning the rotor for rotational movement within the stator ring;

pivotally attaching the at least one stop pawl to the rotor and configured to pivotably engage the brake slot when the rotor reaches the pre-determined rotational velocity; and pivotally securing the latch to the stator ring, the latch configured to, in response to the at least one stop pawl entering the brake slot, secure the stop pawl in the brake slot.

15. The method of claim 14, further comprising forming a calibration slot in the stator ring.

16. The method of claim 14, further comprising forming the brake slot at a position in the stator ring of between about 260 and 280 degrees from the uppermost portion of an internal surface of the stator ring in a direction of rotation of the rotor when the barrier is lowered.

17. The method of claim 14, further comprising pivotally attaching a second stop pawl to the rotor.

18. The method of claim 17, further comprising pivotally attaching the second stop pawl to the rotor at a position opposite to the at least one stop pawl.

19. A rolling barrier system, comprising:

a barrier connected to a roll cylinder, wherein the roll cylinder is connected to a drive shaft;

a rotor connected to the drive shaft, wherein the rotor comprises a stop pawl pivotally attached to the rotor, the stop pawl biased toward the rotor and pivotable away from the rotor when the rotor increases its rotational velocity, wherein the stop pawl has a front face defining a first plane of rotation;

a stator encircling the rotor and remaining stationary during the rotor rotation, wherein the stator comprises a brake slot on an inner surface of the stator and wherein the stator is positioned such that the brake slot is positioned approximately opposite from a location at which the barrier unrolls from the roll cylinder so that the stop pawl contacts the brake slot when the drive shaft exceeds a pre-determined angular velocity; and a latch attached to the stator, the latch having a bottom face defining a second plane of rotation and the latch is rotatable in the second plane of rotation away from and parallel to the first plane of rotation, wherein the latch is biased toward the brake slot such that when the stop pawl enters the brake slot, the latch prevents the stop pawl from bouncing away from the brake slot; wherein the latch engages an axial protrusion on the stop pawl, the axial protrusion extending from the front face of the stop pawl in a direction non-parallel relative to the first plane.

20. The system of claim 19, wherein the rotor comprises a first stop pawl and a second stop pawl positioned opposite the first stop pawl on the rotor.

21. The system of claim 19, further comprising a biasing mechanism disposed on the rotor for biasing the stop pawl toward the rotor.

* * * * *